US008403776B1

(12) United States Patent
Gruenwald

(10) Patent No.: US 8,403,776 B1
(45) Date of Patent: Mar. 26, 2013

(54) UNBREAKABLE GOLF TEE WITH FLEXIBLE SHAFT

(75) Inventor: Mark James Gruenwald, Reeseville, WI (US)

(73) Assignee: Mark J. Gruenwald, Reeseville, WI (US)

( * ) Notice: Subject to any disclaimer, the term of this patent is extended or adjusted under 35 U.S.C. 154(b) by 58 days.

(21) Appl. No.: 12/909,827

(22) Filed: Oct. 22, 2010

(51) Int. Cl.
*A63B 57/00* (2006.01)

(52) U.S. Cl. ..... 473/387

(58) Field of Classification Search ..... 473/387–403; D21/717–719
See application file for complete search history.

(56) References Cited

U.S. PATENT DOCUMENTS

| | | | | | |
|---|---|---|---|---|---|
| 1,593,480 | A * | 7/1926 | Thompson | 473/394 |
| 3,203,700 | A * | 8/1965 | Antonious | 473/257 |
| 3,408,079 | A * | 10/1968 | Kirikos | 473/398 |
| D370,041 | S * | 5/1996 | Thomas | D21/718 |
| 5,571,055 | A * | 11/1996 | Lewis et al. | 473/398 |
| D468,379 | S * | 1/2003 | Gan | D21/717 |
| 6,849,008 | B1 * | 2/2005 | Wang | 473/401 |
| D511,193 | S * | 11/2005 | Trawoger | D21/718 |
| 7,344,456 | B2 * | 3/2008 | Hayton | 473/396 |
| D621,456 | S * | 8/2010 | Cathro | D21/718 |
| 2002/0002088 | A1 * | 1/2002 | Greenberger | 473/400 |
| 2002/0013186 | A1 * | 1/2002 | Webb | 473/399 |
| 2005/0148410 | A1 * | 7/2005 | DeLisle et al. | 473/387 |

* cited by examiner

*Primary Examiner* — Steven Wong

(57) ABSTRACT

A golf tee made from durable materials with an upper portion flexible shaft of the tee providing a method for the tee to flex freely when struck and return to its normal position without wear or damage. The insertion height of the tee is controlled with a height disk formed in the center of the tee that allows pushing the tee into the ground consistently each time. A fluted bottom post of the tee provides stabilizing ribs and increased surface area to contact the ground, thus holding the tee in place more securely than the tradition round tees. A 120 degree angled tri-post ball seat creates a self-centering method for teeing the ball easily and consistently. The durable material the tee is constructed from provides durability allowing the tee to be used repeatedly without wear or breaking.

5 Claims, 3 Drawing Sheets

UNBREAKABLE GOLF TEE WITH FLEXIBLE SHAFT

CROSS-REFERENCE TO RELATED APPLICATION

This application claims priority on the basis of provisional patent application No. 61/254,569 filed Oct. 23, 2009.

BACKGROUND

The invention was developed to solve several issues common to current golf tee methods in a single encompassing design. Wooden and plastic golf tees do not give or absorb the impact of the golf club and often break or mare the clubface. Although there are flexible tees, their durability is often limited and many are difficult to insert into hard ground. In trying to achieve lower friction to the clubface, such as brushes or thin prongs, the designs make teeing the ball difficult or break easily upon impact. Unlike the invention, current wooden and plastic golf tees are difficult to insert to a specific height and are not consistent in teeing the golf ball accurately. Although some plastic tees are considered durable compared to wooden tees, many do not flex and are significantly less durable than the invention and can cause clubface deflection during impact.

SUMMARY OF THE INVENTION

To overcome the issues as stated above, the invention uses a proven unbreakable polymer material. The design provides a flexible, low impact resistant method, using a unique system of conical shaped relief holes, allowing the use of unbreakable high strength polymers, yet allowing flexibility in the design. The design provides tees in specific accurate heights using a height shoulder disk for easy, consistent, insertion into the ground and repeatable insertion distances above ground. A contoured, fluted bottom insert post that gives during impact yet provides enough stiffness for insertion into harder ground while providing additional friction to hold the tee in place due to the convoluted surface area.

BRIEF DESCRIPTION OF THE DRAWINGS

A preferred embodiment will be set forth in detail with reference to the drawings, in which.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally relates to a flexible and reusable golf tee that can be used at specific heights.

Figure 1:
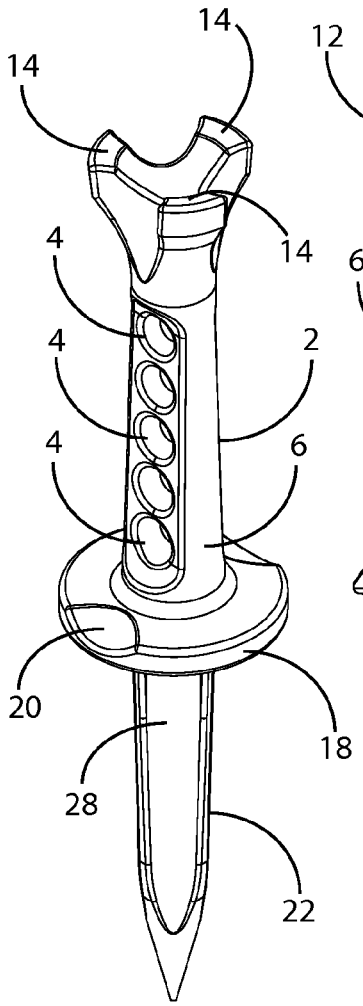
FIG. 1 Shows a perspective view of the golf tee.
Figure 2:
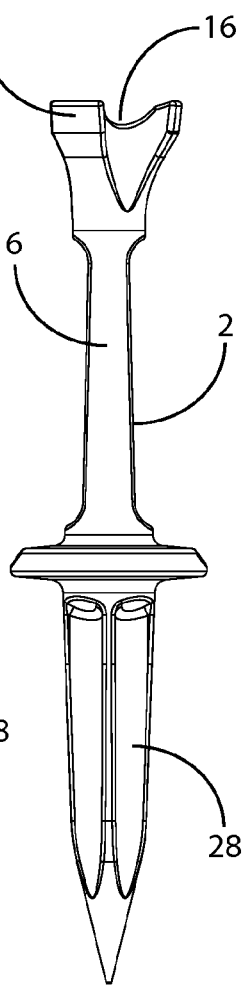
FIG. 2 Shows a side view of the golf tee.
Figure 3:
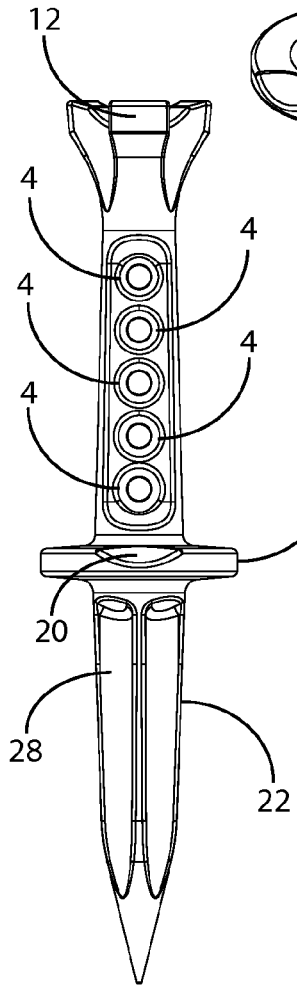
FIG. 3 Shows a front view of the golf tee.
Figure 4:
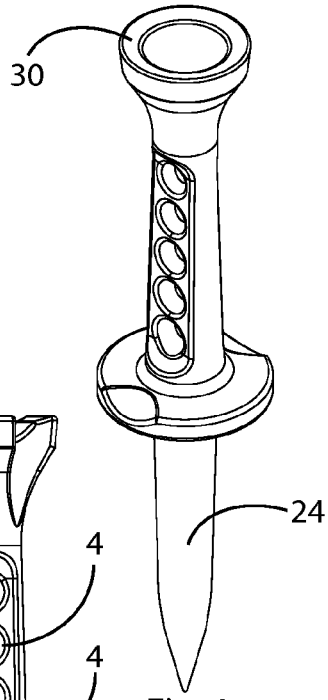
FIG. 4 Shows a perspective view of the golf tee with an optional ball seat design and optional stake design.
Figure 5:
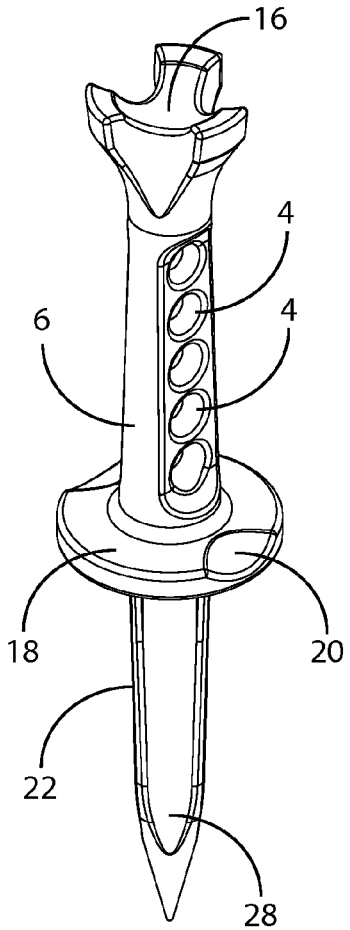
FIG. 5 Shows a perspective view from a different angle of the golf tee.
Figure 6:
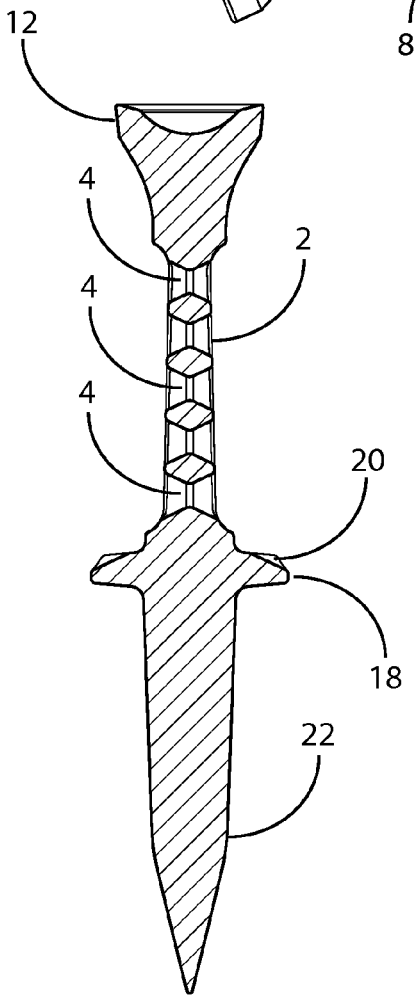
FIG. 6 Shows a cross-sectional view of the golf tee detailing the compressive relief cone recess area of the design.
Figure 7:
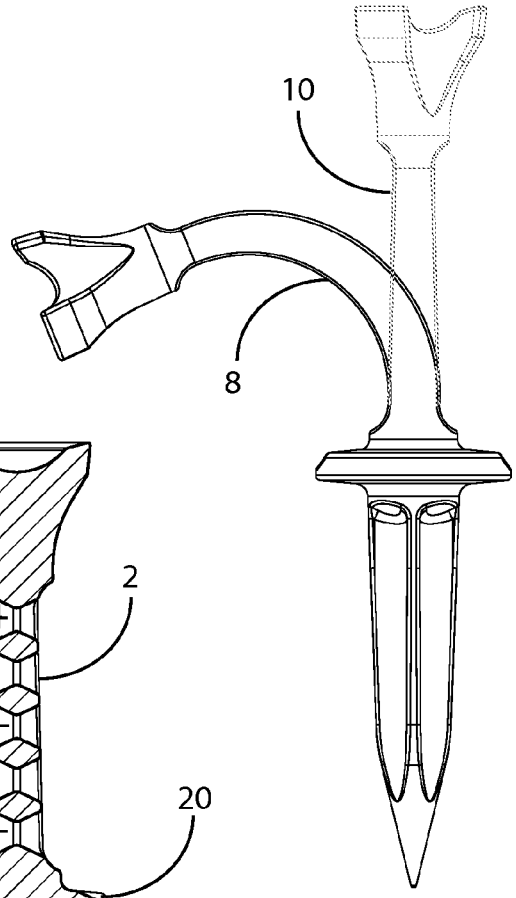
FIG. 7 Shows a side view of the golf tee when struck showing the flex bending motion that occurs during impact and its return to vertical.
Figure 9:
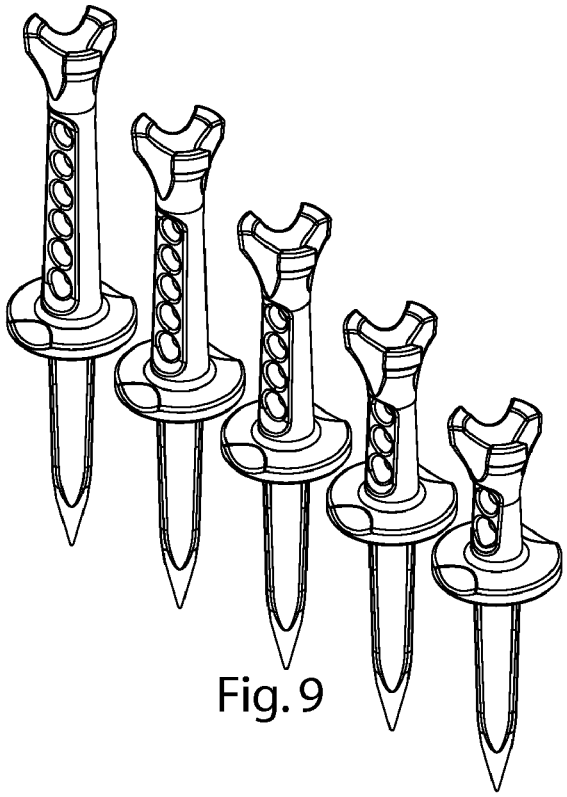
FIG. 9 Shows a perspective view of the various sizes of the golf tee.
Figure 8:
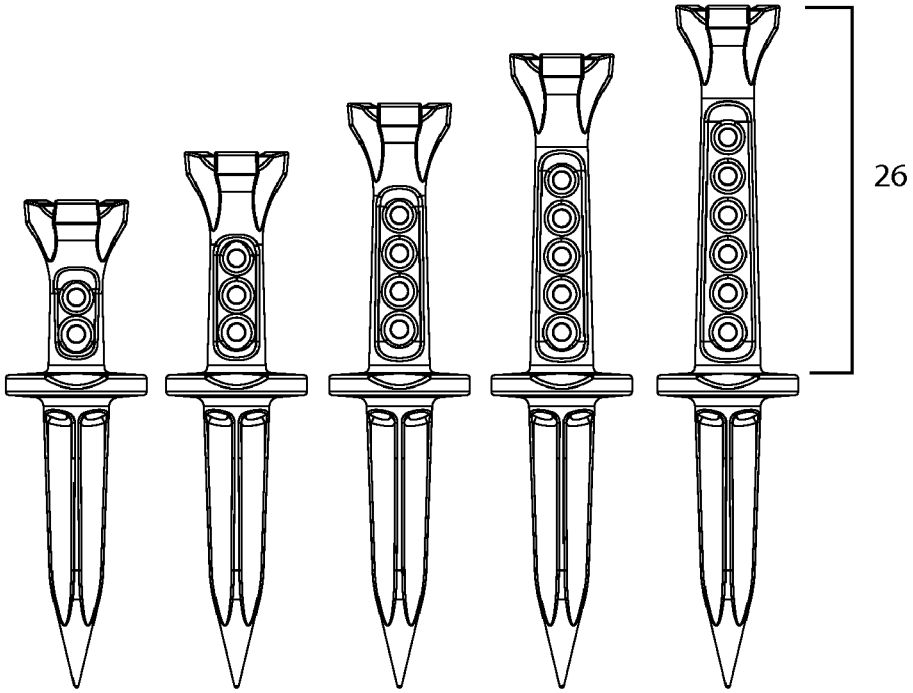
FIG. 8 Shows a front view of the various sizes of the golf tee.

Referring to FIG. 1 through FIG. 9, a flex-head golf tee 2 allows a golfer to tee a ball accurately above ground to a specific height and provides a tapered flexible shaft 6 during ball striking to minimize resistance to the club face. A compression relief cone recess design 4 allows the force generated during ball striking and shaft bending 8 to be dissipated during the flexing moment, thus reducing interference of the tee 2 to the face of a golf club and reducing the deflection of the club that may cause improper ball trajectory. The compression relief cone recess 4 provides a funnel type conduit void of material that allows compression of materials to bend and flex without breaking or tearing. The tapered flexible shaft 6 provides increased strength during the bending moment 8 towards the base of the tee 2, allowing the shaft 6 to flex. This allows the tapered flexible shaft 6 to be strong enough to hold the ball weight during teeing, allows the shaft 6 to bend freely during ball striking, and also allows the upper portion of the tee 2 to return to a vertical position 10 after being stuck. Because the energy of the club impact is dissipated from the compression relief cone recesses 4, the tee 2 is extremely durable and can be used repeatedly. The 120 degree angled tri-post ball support 12 provides a self-centering seat recess 16 area that allows easy placement of the golf ball, thus allowing the ball to seat properly without trying to conform to the spherical shape of the outside diameter of the ball like traditional wood tees. The 10 to 15 degree angled ring seats 14 are part of the 120 degree angled tri-post ball supports 12 and work in conjunction with the self-centering recess area 16 to allow the ball to naturally fall into place during placement of the ball, even at angles other than vertical.

The tee 2 may also contain a round height disk 18 at specific distances from the 120 degree angled tri-post ball seat area that provides an insertion stop preventing the tee 2 from being inserted further into the soil, thus maintaining a specific height of the ball above ground. The height disk 18 also facilitates straighter insertion of the tee 2 as the disk 18 provides a flat reference to the ground during insertion. The tees 2 would be made in specific heights 26 in which the tapered flexible shaft 6 of the tee is made to different lengths 26, thus providing a series of heights for different club types, such as drivers, woods, hybrids and long irons. Because of the ability to easily modify the height of the tapered flexible shaft 6, any height can be constructed. The height disk also provides two insert directional guides 20 that indicate to the golfer the proper orientation of the tee relative to the compression relief cone recesses 4. They also provide a recessed area for convenient placement of the persons thumb for insertion.

The lower fluted tee stake 22 below the height disk 18 is designed with convoluted recesses 28 to allow easier insertion into the soil and to provide greater surface area contact with the soil to hold the tee solidly in place. The inserted portion may be round 24 similar to a typical wood tee. This portion of the tee 2 can also be made of a separate material and inserted into the upper portion of the tee 2 during manufacturing, thus providing a dual-compound design.

In use, the tee 2 is inserted into the ground to the height disk 18 with the compression relief cone recesses positioned to face the direction of the intended ball path. This allows the tee 2 to bend in the proper direction as the club strikes the ball.

The pointed, fluted tee stake 22 provides a secure insert into the soil to hold the tee 2 in place during the ball strike. The ball is placed on the 120 degree angled tri-post ball support 12. Because the 120 degree angled tri-post ball support 12 contains a self-centering seat recess 16 directly below the balls spherical contour, the ball falls easily into place as it rests against the 10 to 15 degree angled ring seats 14. Once the ball is teed, the ball can be struck normally with any club. Once the club comes into contact with the flex-head tee 2, the tapered flexible shaft 6 bends 8 from the club impact absorbing the impact from the club face and deflecting out of the way 8 as the club moves through the impact zone. The tapered flexible shaft 6 returns to its vertical position 10 and the tee 2 can be used again. If the tee 2 comes out of the ground when struck it can easily be reinserted and used again.

The tee 2 may be made using injection molding with thermo-plastic elastomers (TPE). The fluted tee stake portion can be a separately molded part that can be inserted into the mold that forms the upper portion of the tee. The single part molded tee provides a more durable design. The design can also incorporate various methods similar to the compression relief cone recess 4 to produce the flexible bending 8 of the upper portion of the tee 2 including a tapered round profile. The upper portion of the tee may provide a seating method for the ball but can be a circular angled ring ball seat 30 versus the 120 degree angled tri-post ball support 12 method to hold the ball in place. The bottom stake that is inserted into the ground can also have a round profile 24.

It should be understood, of course, that the foregoing relates to exemplary embodiments of the invention and that modifications may be made without departing from the spirit and scope of the invention as set forth in the following claims:

I claim:

1. A golf tee comprising:

a single molded design utilizing a tapered shaft with compression relief cone recesses allowing flex compression during the bending moment;

a recessed 120 degree angled tri-post teeing ball support with a wide 10 to 15 degree angled ring seats to center the ball easily on the tee;

a height disk used to insert the tee to a specific height above ground for the tee;

a contoured fluted stake for insertion into the ground using the height disk having a tapered point for directional stability during insertion.

2. A golf tee as of claim 1, wherein the tapered shaft having compression relief elements that provide bending relief upon impact to allow low resistance flexibility using high strength Thermoplastic Elastomer (TPE) polymer materials.

3. A golf tee as of claim 1, wherein a recessed, 120 degree angled tri-post ball support design allows self-centering of the ball when placed on the tee wherein a wide 10 to 15 degree angled ring seats enhances the 120 degree angled tri-post support by providing a tangent contact surface with the outside radius of the golf ball.

4. A golf tee as of claim 1, wherein the height disk is molded as part of the tee and provides a consistent stop method for inserting the tee to a consistent height when used, stabilizing the tee during impact, and providing a shoulder for inserting the tee into the soil.

5. A golf tee as of claim 1, wherein the contoured fluted lower stake with a tapered insertion point provides increased friction with the soil from increased surface area.

* * * * *